United States Patent [19]

Hosoya et al.

[11] Patent Number: 4,866,480

[45] Date of Patent: Sep. 12, 1989

[54] DEVELOPING APPARATUS USING ONE-COMPONENT NON-MAGNETIC TONER

[75] Inventors: Masahiro Hosoya, Yokohama; Shigeru Fujiwara, Kawasaki; Tsutomu Uehara, Yokosuka, all of Japan

[73] Assignee: Kabushiki Kaisha Toshiba, Kawasaki, Japan

[21] Appl. No.: 844,373

[22] Filed: Mar. 26, 1986

[30] Foreign Application Priority Data

Mar. 27, 1985 [JP] Japan ..... 60-60928
Mar. 28, 1985 [JP] Japan ..... 60-61836
Jun. 29, 1985 [JP] Japan ..... 60-143504

[51] Int. Cl.[4] ..... G03G 15/08

[52] U.S. Cl. ..... 355/245; 355/261; 118/651

[58] Field of Search ..... 355/14 D, 3 DD; 118/651, 653, 657–658; 29/121.8, 121.4

[56] References Cited

U.S. PATENT DOCUMENTS

| | | | |
|---|---|---|---|
| 2,518,645 | 8/1950 | Shanahan et al. | 29/121.4 X |
| 3,572,288 | 3/1971 | Turner | 118/637 |
| 3,651,758 | 3/1972 | Harrod | 29/121.4 |
| 3,863,603 | 2/1975 | Buckley et al. | 355/3 DD |
| 3,974,554 | 8/1976 | Fantuzzo | 29/121.4 |
| 4,136,637 | 1/1979 | Snelling | 118/658 |
| 4,194,830 | 3/1980 | Ohnuma et al. | 355/3 DD |
| 4,200,389 | 4/1980 | Matsui et al. | 29/121.8 X |
| 4,217,769 | 8/1980 | Damrau | 29/121.8 X |
| 4,325,627 | 4/1982 | Swidler et al. | 118/651 X |
| 4,368,971 | 1/1983 | Watanabe et al. | 355/3 DD |
| 4,377,332 | 3/1983 | Tamura | 355/14 D |
| 4,378,158 | 3/1983 | Kanbe | 355/3 DD |
| 4,380,966 | 4/1983 | Isaka et al. . | |
| 4,395,110 | 7/1983 | Hosono et al. | 355/3 |
| 4,419,959 | 12/1983 | Westdale | 118/658 |
| 4,516,850 | 5/1985 | Nishikawa | 355/3 DD |
| 4,521,098 | 6/1985 | Hosoya et al. | 355/3 DD |
| 4,528,937 | 7/1985 | Kanno et al. | 355/3 DD X |
| 4,558,943 | 12/1985 | Patz | 118/658 |
| 4,575,220 | 3/1986 | Sakamoto et al. | 118/658 |
| 4,616,918 | 10/1986 | Kohyama et al. | 355/3 DD |
| 4,624,545 | 10/1983 | Yasuda et al. | 355/3 DD |
| 4,656,965 | 4/1987 | Hosoya et al. | 118/651 X |
| 4,696,255 | 9/1987 | Yano et al. | 355/3 DD X |

FOREIGN PATENT DOCUMENTS

| | | | |
|---|---|---|---|
| 0071466 | 9/1983 | European Pat. Off. . | |
| 83514 | 7/1970 | German Democratic Rep. . | |
| 57-66455 | 4/1982 | Japan . | |
| 57-86869 | 5/1982 | Japan . | |
| 2163371 | 2/1986 | United Kingdom | 355/3 DD |

*Primary Examiner*—A. C. Prescott

*Attorney, Agent, or Firm*—Foley & Lardner, Schwartz, Jeffery, Schwaab, Mack, Blumenthal & Evans

[57] ABSTRACT

A developing apparatus is disclosed that employs one-component non-magnetic toner. The apparatus includes a movable developing agent carrier that has a surface polished to a first finish, roughened to a second finish, and then metal plated. The agent carried carries a one-component developing agent composed of non-magnetic toner and supplies the developing agent to an electrostatic latent image. An elastic coating member is disposed to press on the surface of the movable developing agent carrier so that the free end thereof is directed opposite to the moving direction of the movable developing agent carrier, and a toner stirring member disposed in a toner container contiguously to or in sliding contact with the movable developing agent carrier. The apparatus provides a uniform toner layer over a long period of time and supplies stable and high quality images.

13 Claims, 5 Drawing Sheets

(a)

(b)

(c)

(a)

(b)

DEVELOPING APPARATUS USING ONE-COMPONENT NON-MAGNETIC TONER

The present Application claims priority of Japanese Patent Application Ser. Nos. 60-60928 filed on Mar. 27, 1985, 60-61836 filed on Mar. 28, 1985 and 60-143504 filed on June 29, 1985.

FIELD OF THE INVENTION AND RELATED ART STATEMENT

This invention relates to a developing apparatus, and more particularly relates to improvements in and concerning a developing apparatus to be used in an electrophotographic system or an electrographic system for converting an electrostatic image formed on a photosensitive material or a dielectric material into a visible image with a one component developing agent formed solely of a non-magnetic toner.

In the developing apparatus of this type, technical advances are taking place in the direction from the type using a two-component developing agent composed of a toner and a carrier to the type using a one component developing agent composed solely of a magnetic toner and are destined to take their course from the type using a one component toner composed solely of a magnetic toner to the type using a one component developing agent composed solely of a non-magnetic toner.

The developing apparatus of the type using a one component developing agent composed of a non-magnetic toner effects desired image development by applying the non-magnetic toner uniformly in the form of a thin layer on the surface of a rotating carrier roll and allowing the applied toner to be transferred onto an electrostatic image on a rotating photosensitive drum disposed parallelly to and opposite the carrier roll across a fine gap in proportion to the charge lodged.

The developing apparatus of the type using a one component developing agent composed of a non-magnetic toner, however, has one serious problem that it is difficult to form a uniform thin layer of the toner stably on the surface of the carrier roll. This problem has impeded practical adoption of the developing apparatus.

In view of this true state of affairs, the inventors formerly succeeded in enabling formation of a thin layer of a non-magnetic toner by perfecting a developing apparatus illustrated in FIG. 1 (Japanese Patent Application SHO 58(1983)-182,743). The developing apparatus of this former invention accomplishes desired development of an electrostatic image by disposing a metal plate blade 2 in such a manner as to keep the rear side of the free end thereof, namely the flat surface on the downstream side thereof relative to the flow of a developing agent, in pressed contact with the peripheral surface of a carrier roll 1 having irregularities formed on a surface serving as a developing agent carrier thereby enabling a non-magnetic toner 4 supplied as from a toner container 3 to be applied in the form of a thin layer of toner on the surface of the carrier roll 1 with the aid of the aforementioned metal plate blade 2 and opposing the thin layer of toner to a photosensitive drum 5 serving as an image carrier.

In this developing apparatus, when the carrier 1 having irregularities formed on the surface thereof is rotated clockwise, the non-magnetic toner 4 in the toner container 3 is transferred along the carrier roll 1 to the interface between the metal plate blade 2 possessing elasticity and the carrier roll 1.

The metal plate blade 2 has a large modulus of elasticity as compared with a rubber plate and meagerly lacks uniformity of the amount of deformation due to lack of uniformity of the pressure as of a fitting jig and exhibits minimal plastic deformation. Thus, the force with which the metal plate blade 2 is pressed against the carrier roll 1 is made uniform and the thin layer of toner, therefore, is formed in a uniform thickness. Moreover, since the metal plate blade 2 possesses electroconductivity, it can prevent the rear surface charging due to the triboelectricity possibly caused when the metal plate blade 2 is placed into pressed contact with the non-magnetic toner 4. As a result, the shear strength exerted on the aggregate of toner is constant at all times and the thin layer of toner can be formed in an uniform thickness.

This formation of the thin layer of toner is effected, as illustrated in FIG. 2, by the repetition of the shear strength of the toner aggregate 7 under the exertion of the inhibiting force $F_1$ generated by the metal plate blade 2 and the conveying force $F_2$ generated by the carrier roll 1. When the surface smoothness of the carrier roll 1 is high, the toner aggregate 7 stagnates between the carrier roll 1 and the metal plate blade 2 because slippage occurs between the toner aggregate 7 and the carrier roll 1. As a result, the subsequent toner cannot pass this position and the thin layer of toner is liable to sustain comby streaks thereon. This trend gains in prominence when the toner adopted has a strong self-aggregating property. As regards this problem, the slippage between the toner aggregate 7 and the carrier roll 1 can be prevented to permit formation an uniform thin layer of toner despite the toner's self-aggregating property by imparting irregularities 6 to the surface of the carrier roll 1. As means of giving irregularities to the surface of the carrier roll 1, a method which comprises subjecting the surface to a treatment of sand blasting and/or a subsequent treatment of metal plating may be cited. For the developing apparatus of the type using a one component developing agent composed solely of a non-magnetic toner, it is extremely important that the irregularities should be formed on the surface of the carrier roll 1. The conventional method for the fabrication of the surface of the carrier roll 1 has not been sufficient for stable reproduction of images of satisfactory quality.

In the developing apparatus described above, the thin layer of toner is obtained in a thickness of about 60 to 120 μm, generally above 80 μm by keeping the metal plate blade 2 pressed strongly against the carrier roll 1. The images, therefore, are reproduced in sufficient density. The application of such high pressure, however, has entailed a problem that the pressure is transmitted also to the toner to give birth to frictional force and fogging of image. When the pressure applied to the metal plate blade 2 is increased to decreased to the thickness of the thin layer of toner, although the desired decrease of the layer thickness is indeed obtained, the toner is more liable to conglomeration and aggregation and the electric charge applied to the toner is apt to assume an unwanted opposite polarity. Thus, it is difficult to maintain the formation of an uniform thin layer of toner for a long period of time and to ensure stable reproduction of images of high quality.

OBJECTS AND SUMMARY OF THE INVENTION

The first object of this invention, therefore, is to provide a developing apparatus capable of forming a stable and satisfactory image with a one-component developing agent composed of a non-magnetic toner.

The second object of this invention is to provide a developing apparatus capable of forming an image in high resolution without entailing the problem of fogging by the use of a one-component developing agent composed solely of a non-magnetic toner.

The third object of this invention is to provide a developing apparatus capable of stably forming an image of high quality by the use of a one-component developing agent composed solely of a non-magnetic toner such that the toner undergoes neither conglomeration nor aggregation and assumes no electric charge of opposite polarity and, as a result, the formation of an uniform thin layer of toner can be maintained for a long period of time.

The other objects of this invention will become apparent from the following description of the invention.

DETAILED DESCRIPTION OF THE PREFERRED EMBODIMENTS

Figure 1:
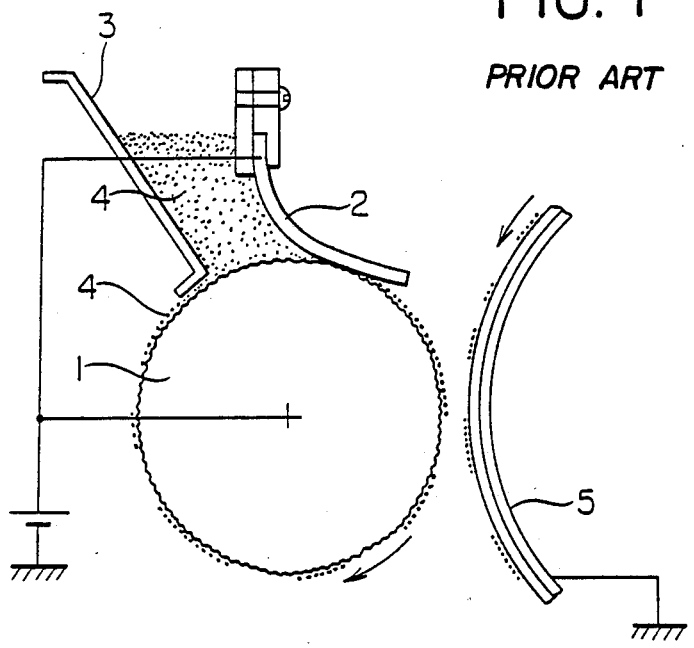
FIG. 1 PRIOR ART
FIG. 1 is a cross section schematically illustrating of a conventional developing apparatus.
Figure 2:
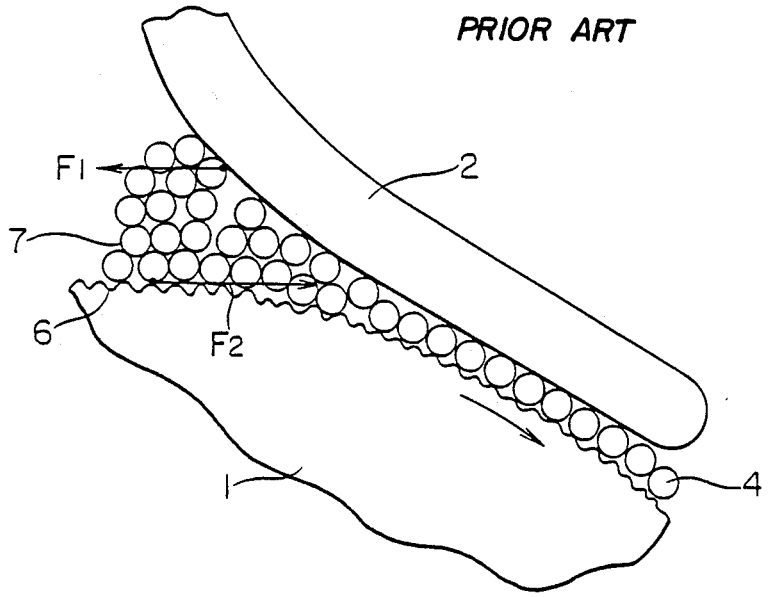
FIG. 2 PRIOR ART
FIG. 2 is a cross section illustrating, as magnified, the metal plate blade part of the conventional developing agent.
Figure 3:
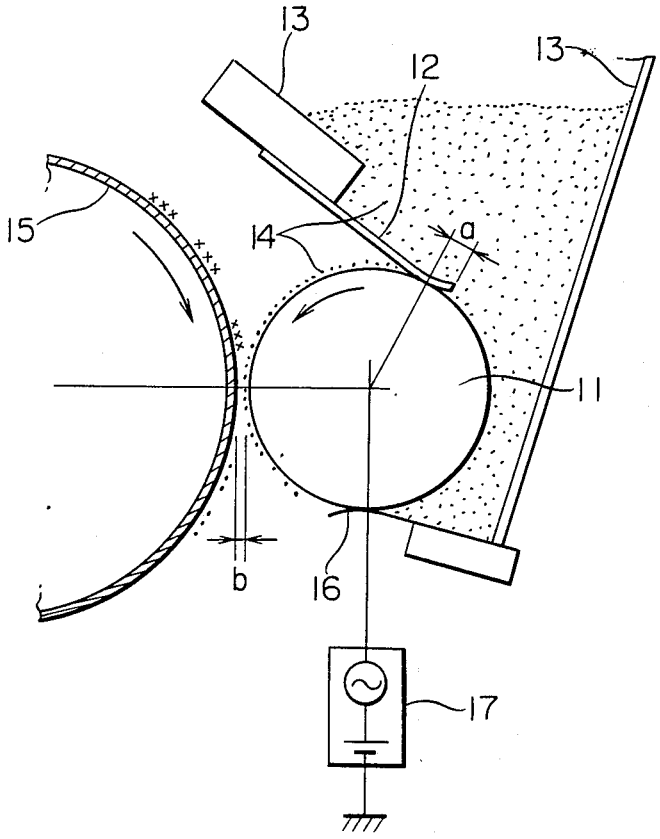
FIG. 3 is a cross section schematically illustrating a typical developing apparatus embodying the present invention.

In the diagram of FIG. 3, 11 denotes a carrier roll, i.e. a movable developing agent carrier rotatably supported in place. The surface (image surface) of this carrier roll 11 is roughened to form irregularities. The free end of an elastic metal plate blade 12 is disposed, as illustrated, in a direction opposite the direction of rotation of the carrier roll 11. The flat surface part at the leading end thereof is pressed against the carrier roll 11. A toner container 13 holds therein a one component developing agent 14 composed solely of a non-magnetic toner. As the carrier roll 11 having irregularities on the surface thereof is rotated, the one-component developing agent 14 is fed toward a small wedge-shaped portion formed between the carrier roll 11 and the elastic metal plate blade 12. At this time, by the action of inhibiting force of the elastic metal plate blade 12 and transferring force of the carrier roll 11, the toner mass is sheared and caused to form a thin layer of toner.

The part of the non-magnetic toner 14 which has passed under the elastic metal plate blade 12 is electrically charged by the friction thereof against the elastic metal blade 12 to acquire a prescribed charge. The electrically charged non-magnetic toner 14 is electrostatically attached to the carrier roll 11 and, in consequence of the rotation of the carrier roll 11, transported to a developing part adjoining a photosensitive drum 15. This sensitive drum 15 has an electrostatic image formed thereon by the method well known to the art. By the electric field to be formed of the potential of the image and the potential applied to the carrier roll 11 by a bias power source 17, the non-magnetic toner 14 already charged electrically as described above is transferred from the carrier roll 11 to the sensitive drum 15, to effect development of the image.

The part of the non-magnetic toner 14 which has not participated in the development of image within the developing part and is still remaining on the carrier roll 11 is passed between a flexible recovery blade 16 and the carrier roll 11 and recovered in the toner container 13. Particularly in the developing apparatus of this invention, the elastic metal plate blade 12 is pressed in the direction opposite the direction of rotation of the carrier roll 11 so as to decrease the wedge shaped portion as much as possible and prevent the non-magnetic toner 14 from being excessively forced into the wedge-shaped portion. Owing to this arrangement, the thin layer of non-magnetic toner 14 can be formed stably even when the force with which the elastic metal plate blade 12 is pressed against the carrier roll 11 is relatively small. The metal plate which forms the elastic metal plate blade 12 is only required to possess flexibility. As examples of the metal plate satisfying this requirement, there may be cited stainless steel plate and phosphor bronze plate. Particularly when a phosphor bronze plate is used, among other available materials for the applicator, it is desirable from the standpoint of forming the thin layer of toner in a proper thickness and conferring a proper electric charge upon the toner to select the thickness of the plate in the range of 0.1 to 0.4 mm. This is because it is important for the formation of the thin layer of toner and the electric charging of toner to acquire proper force of pressure and nipping width. The elastic metal plate blade 12 pressed against the carrier roll 11 is held in pressed contact so as to form a certain nipping width. With the center of this nipping width assumed as the position of contact, the length from the center of the nipping width to the free end of the elastic metal plate blade 12 (the portion indicated as "a" in the diagram) is desired to be defined in the range of 1 mm to 5 mm. The definition of the length mentioned above is intended to preclude the possibility that the formation of the uniform thin layer of toner will become extremely difficult even under high mechanical strength when the free end of the elastic metal plate blade 12 is pressed fast against the carrier roll 11 and the possibility that the wedge shaped portion will excessively increase when the length is too large. Under the condition, the thin layer of toner can be formed in an extremely small and uniform thickness by selecting the pressure of the elastic metal plate blade 12 against the carrier roll 11 in the range of 10 g/cm to 100 g/cm. The term "force of pressure" as used herein means the magnitude of pressure per 1 cm of a length parallel to the central axis of the carrier roller 11. If this force of pressure is less than 10 g/cm, since the inhibiting force of the metal plate blade 12 (the force tending to impede passage of the toner under the force of pressure) is small, the toner mass passes under the force of pressure in a state not sufficiently shared into a thin layer and, consequently, the thin layer of toner formed on the surface of the carrier roller acquires a large thickness. As a result, the image density is increased and, at the same time, the amount of the noncharged toner escaping electrification by the friction with the metal plate blade 12 is increased and the image fogging is induced and the resolution is degraded. If the force of pressure exceeds 100 g/cm, the thickness of the thin layer of toner is decreased extremely and the image density is no longer obtained sufficiently.

In the diagram, numeral 16 denotes a elastic blade used for recovering the toner remaining on the surface of the carrier roll 11 after escaping participation in the development of an image. Similarly to the elastic metal plate blade 12, this blade has the free end thereof kept from intimate contact with the carrier roll 11. The force of pressure exerted on the blade is desired to be smaller than the force of pressure exerted on the carrier roll 11. As examples of materials usable for this blade, there may be cited plastic films and thin plates of rubber and metal. This recovery blade 16 concurrently serves to prevent the toner 4 from spilling out the toner container 13.

The numeral 17 in the diagram denotes a power source used for applying a bias voltage on the carrier roll 11 and the elastic metal plate blade 12 and the numeral 15 a photosensitive drum of selenium i.e. an image carrier opposed to the carrier roll 11. The surface potential of the sensitive material is in the range of +400 to +900 V. A good image is reproduced by using the bias voltage in the range of +100 to +200 V in the case of DC and in the range of Vpp=1.5 to 2.0 KV (peak to peak) (1 to 3 KHz) in the case of AC. The distance (indicated as "b" in the diagram) between the sensitive drum 15 and the carrier roll 11 is in the range of 0.15 to 0.25 mm. Desirably, the photosensitive drum 15 is kept out of touch with the thin layer of toner.

Figure 4:
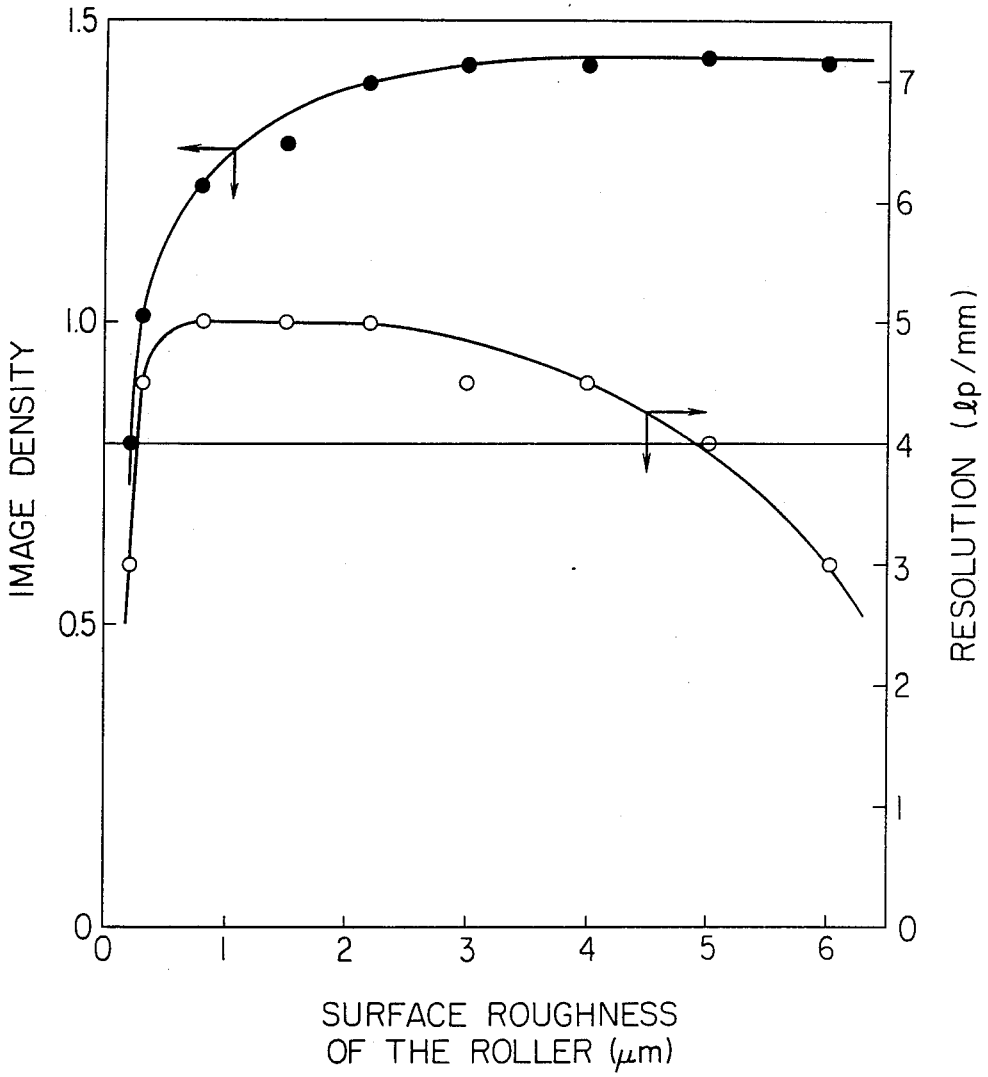
FIG. 4 is a graph showing the relation among the surface roughness of the carrier roll, the image density, and the resolution.

In the developing apparatus constructed as described above, the thin layer of toner is formed uniformly and the reproduction of images of high quality is maintained reproduced stably when the roughness of the surface of the carrier roll 11, expressed by the 10-point average specified in JIS (JIS-B-0601 "Definitions and Designation of Surface Roughness"), is in the range 0.3 to 5.0 μm Rz, preferably 0.4 to 3.0 μm Rz, As clearly noted from the graph of FIG. 4, the resolution and the image density both reach their respective maximum values when the average roughness falls in the range of 0.3 to 5.0 μm Rz. If the surface roughness of the carrier roll 11 exceeds 5 μm Rz, the transferring force relative to the non-magnetic toner 14 is increased and the layer of toner is formed in a relatively large thickness and, while the image is produced in high density, the image is liable to suffer from foggings. Further, since the amount of toner adhering to the sensitive material is excessive, the resolution is degraded. If the surface roughness is less than 0.3 μm Rz, since the transferring force relative to the non-magnetic toner is insufficient, the formation of an uniform thin layer of toner is attained with difficulty and, as the result, is no longer reproducible and the resolution is degraded.

Even when the surface roughness exceeds 5 μm Rz, a relatively satisfactory toner layer can be obtained by increasing the force of pressure exerted on the elastic metal plate blade 12 for contact with the developing roll 11. In this case, however, the non-magnetic toner 14 is more liable to conglomeration or aggregation.

This invention prevents the toner from conglomeration or aggregation and permits formation of an uniformly electrified toner layer by moderating the force of pressure exerted on the metal plate blade 12 for contact with the carrier roll 11 and realizes reproduction of images of very fine quality by using a one-component developing agent composed of a non-magnetic toner. The thickness of the layer of toner and the magnitude of electric charge assumed by the toner are important factors which also determine the quality of the image. By a deliberate study carried out with the apparatus this invention, it has been confirmed that images of good quality are obtained by selecting the thickness of the layer of toner in the range of 10 μm to 80 μm and the absolute value of the charge assumed is in the range of 2 μC/g to 10 μC/g. f the thickness of the layer of toner exceeds 80 μm, the image gains in density and tends to entail fogging and the resolution is degraded. If it is less than 10 μm, the image density is remarkably low. The results are particularly desirable when the thickness is in the range of 20 to 60 μm. If the magnitude of electric charge exceeds 20 μC/g, the development is obtained with difficulty and the image density is degraded. If it is less than 2 μC/g, the image suffers from heavy fogging. The thickness of the toner layer is determined with an optical microscope and the magnitude electric charge is determined by the blowoff method which comprises sucking the thin layer of toner formed on the surface of the developing roller and, during the suction, measuring the amount of electric charge escaping from the developing roller.

Now, the method of fabrication for surface roughening will be described below with reference to a working example using an aluminum carrier roll 11 having a diameter of 40 mm and supported in place rotatably in the counterclockwise direction.

On the surface of this carrier roll 11, irregularities of 0.68 μm as indicated by the 10-point average roughness specified in JIS were formed by subjecting the surface to a treatment for surface roughing and a subsequent treatment by sand blasting and coating the resulting surface with nickel applied in a thickness of 10 μm by the technique of electroless plating. As the elastic metal plate blade 12, a phosphor bronze plate 0.2 mm in thickness was used. This phosphor bronze plate had the flat face part (the rear side) thereof except for the free end pressed against the carrier roll 11. The part indicated as "a" in the diagram was given a size of 2 mm. The force of pressure was 70 g/cm. As the image carrier, a selenium photosensitive drum 15 was used. As the non-magnetic toner 14 to be held in the toner container 13, a toner containing polyester, carbon, a charge controlling agent, etc. and having an average particle size of 11.3 μm was used. The peripheral speed of the sensitive drum 15 and that of the carrier roll 11 were both 110 mm/sec. and the distance, "b", between them was 0.2 mm. The bias potential applied to the carrier roll 11 and the metal plate blade 12 was +150 V in the case of DC and Vpp=1.8 KV (peak to peak voltage) and 2 KHz in the case of AC.

In the developing apparatus constructed as described above, when the thin layer was formed of the non-magnetic toner 14, the thickness of the toner layer was 26 μm and the magnitude of charge determined by the suction blowoff method was −7.0 μC/g. The development of an image was effected by allowing the thin layer of toner formed as described above to be transferred without contact to the selenium sensitive drum, 15 opposed to the carrier roll 11. The toner so transferred to the selenium sensitive drum 15 was transferred onto an ordinary sheet of paper and fixed by the well-known method. The image density was 1.40, the resolution was 5 line pairs/mm, and the image had absolutely no discernible fogging. In a running test, the image reproduced after 40,000 duplications no discernible change.

In the same developing apparatus, the development is carried out by following the procedure described above, except that the surface roughness of the carrier roll 11 was changed to 5.9 Rz. In this case, the thickness of the layer of toner was 120 μm and the image density was 1.50, while the image suffered from fogging and the resolution was 3.2 line pairs/mm. Under these conditions, when the force of pressure exerted on the metal plate blade 12 for contact with the carrier roll 11 was set to 250 g/cm, the thickness of the layer of toner was 73 μm and the occurrence of image fogging and the decline of resolution were prevented. In a running test, however, the developing agent 14 formed an aggregate and the formation of an uniform thin layer of toner was obtained with difficulty after about 30,000 duplications.

Now, the method for processing the carrier roll by the treatments of surface polishing, surface roughening, and metal plating will be described below with reference to a working example.

The polishing of the surface of the carrier roll was effected with a diamond tool, for example until the surface roughness, Rz, falls below about 0.3 μm in the circumferential direction or in the axial direction of the carrier roll. Then, the polished surface of the carrier roll was ready to be roughned by any desired method. This roughing of the surface of the carrier roll could be effected by various methods. For example, the method of sand blasting using alumina particles of a grain size of #240 to #3000, preferably #400 to #800 proved suitable. The irregularities formed on the surface of the carrier roll by the sand blasting technique for surface roughing have sharp ridges. When this surface is directly used, the tips of such sharp ridges may be chipped or the developing agent may be attached fast to the roughened surface of the carrier roll and, as a result, the developing agent carrier may suffer a reduction in the service life, and the reproduced images may be degraded. By subjecting the surface of the developing agent carrier which has undergone the treatment by sand blasting to a plating treatment, the sharp ridges of the irregularities on the surface of the carrier roll can be moderated and, at the same time, the surface hardness can be heightened. As a result, safe formation of images can be stably maintained. Various techniques are available for the plating treatment to be given for the purpose mentioned above. For example, the hard chromium plating treatment, preferably the electroless nickel plating treatment otherwise called the Catalytic Nickel Generation treatment, can be adopted advantageously for the plating. The hard chromium plating treatment proves to be the best method in consideration of the resistance to wear. Since it is one form of the so-called electroplating treatment, the metal being deposited adheres preferentially in a larger thickness to the ridges of irregularities and at times fails to adhere to the grooves at all. This treatment, therefore, improves the resistance to wear and, as concerns the prevention of fast toner adhesion, proves effective more or less but cannot be expected to bring about any appreciable improvement. The electroplating treatment raises a problem that the quality of the produced plating hinges on the material of the roll and the condition of the pretreatment. In contrast, the Catalytic Nickel Generation, otherwise called the electroless plating or chemical plating, is capable of producing an uniform plating without reference to the irregularities of the surface. Further, the Catalytic Nickel Generation treatment produces a plating of higher hardness than the plating of aluminum, for example, and is capable of further enhancing the hardness of the plating, when necessary, by a heat treatment. The plating, when treated at a temperature of 400° C., for example, acquires the same degree of wear resistance as the hard chromium plating. For the developing apparatus of this invention, the wear resistance is amply obtained when the thickness of the plating produced by this plating treatment falls in the range of 5 to 20 μm.

Figure 5:
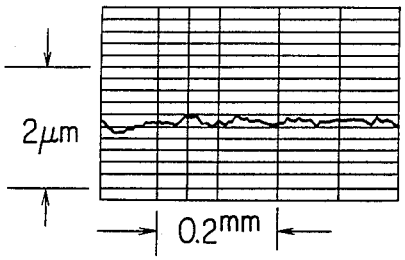
FIG. 5*a, b* and *c* are characteristic diagrams showing a typical condition of the surface, roughness of a developing agent carrier used in another embodiment of the present invention.
Figure 5:
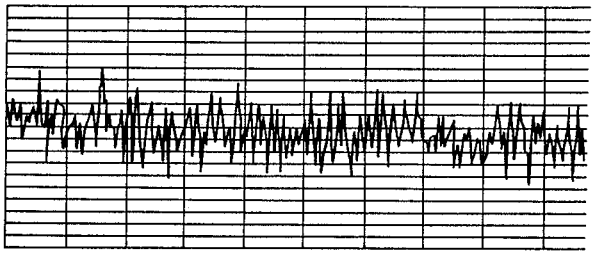
Figure 5:
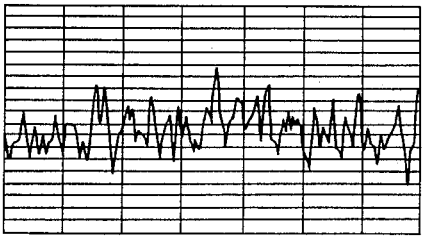
Figure 6:
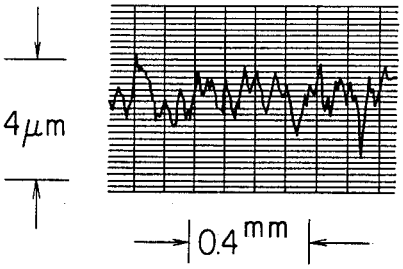
FIG. 6*a* and *b* are characteristic diagrams showing a condition of the surface roughness of a comparative developing apparatus.
Figure 6:
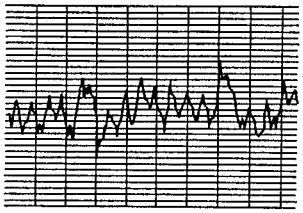

FIG. 5 is a characteristic diagram showing the condition of the surface roughness of the developing agent carrier to be used in the developing apparatus of this invention. In FIG. 5, the part "a" represents the surface roughness, Rz=0.2 μm as expressed by the 10-point average roughness specified JIS-B-0601 "Definitions and Designation of Surface Roughness"), obtained by the polishing treatment on the developing carrier of aluminum having a finished surface 6.3S in roughness. The part "b" of FIG. 5 shows the condition of surface roughness obtained by subjecting the roll of the surface roughness of the part "a" to a sand blasting treatment using #600 particles in grain size. In this case, the value of Rz is 1.56 μm. The condition of the surface roughness obtained by further subjecting the roll of the surface roughness of the part "b" to an electroless nickel plating Catalytic Nickel Generation treatment is shown in the part "c" of FIG. 5. The thickness of the plating is 10 μm. In this case, the value of Rz is 0.68 μm. FIG. 6 is a characteristic diagram showing the condition of the surface roughness of a comparative roll. The characteristic of surface roughness which a roll of aluminum finished to a surface roughness of 6.3S and subjected, without any polishing treatment, to a sand blasting treatment using #600 particles in grain size acquires is shown in part "a" of FIG. 6. Since the roll possessing coarse irregularities on the surface at first is subjected to the sand blasting treatment, the ridges of the irregularities are scraped off and smoothened slightly and the grooves thereof are suffered to remain intact. It is, therefore, extremely difficult to obtain on this roll a desired surface roughness effectively with high repeatability.

In the developing agent carrier having a surface which has undergone the treatments of the comparative case described above, the treatments themselves have drawbacks of their own and confer peculiar undulations on the carrier surface and impair the uniformity of the formation of a toner layer. This lack of the uniformity is responsible for degradation of the quality of a reproduced image.

A developing agent carrier possessing surface roughness and hardness proper for the developing apparatus of this invention is obtained by subjecting the surface of a carrier roll to the treatments of polishing, roughening, and metal plating in the order mentioned as contemplated by the present invention.

Now, a concrete example in which a developing agent carrier undergone the treatments of polishing, roughening, and metal plating in the order mentioned is set in place in a developing apparatus of the construction illustrated in FIG. 3 will be described. A selenium drum was used as the photosensitive drum 5. The surface potential of the drum was +500 V. To the carrier roll 11, a bias potential having a DC (+150) and an AC (1.8 KV peak to peak, 2 KHz) superimpulsed was applied. When projecting development was carried out with the gap between the photosensitive drum 5 and the carrier roll 1 fixed at 0.2 mm, the results shown in table 1 were obtained. In table 1, Sample No. 1 was a developing agent carrier obtained by subjecting a roll of aluminium of a polished surface to a sand blasting treatment using alumina particles #280 in grain size and a plating treatment for producing a nickel layer 10 μm in thickness. Sample No. 2 through Sample No. 5 were developing agent carriers obtained by following the procedure of Sample No. 1, except that the sand blasting treatment was effected by using alumina particles of #400 in grain size as No. 2, alumina particles of #600 in grain size as No. 3, alumina particles of #800 in grain size as No. 4 and alumina particles of #1000 in grain size as No. 5 respectively.

TABLE 1

| Sample No. | Surface roughness Rz (μm) | Image density | Resolution (line pairs/mm) |
|---|---|---|---|
| 1 | 4.2 | 1.45 | 3.5 |
| 2 | 2.4 | 1.35 | 4.5 |
| 3 | 0.68 | 1.30 | 5.0 |
| 4 | 0.45 | 1.30 | 5.0 |
| 5 | 0.42 | 1.30 | 4.5 |

It is noted from the results that the image density increases and the resolution decreases in proportion as the surface roughness Rz increases and that the toner transporting force is weakened and the resolution is lowered in proportion as the surface roughness is decreased extremely. For practical purpose, the surface roughness falls in the range of 0.3 to 5.0 μm, preferably 0.4 to 3.0 μm.

It has been confirmed that the developing apparatus according with the present invention not only gives highly desirable reproduced images but also permits uniform and stable images to be reproduced for a long period of time. As compared with the conventional developing apparatus which has a copy life of some thousands of duplications, the developing apparatus of this invention shows absolutely no discernible sign of such defects as fast adhesion of toner to the carrier roll, degradation of image, and abrasion of the surface of the developing agent carrier in a copy life test of 40,000 to 60,000 duplications.

Figure 7:
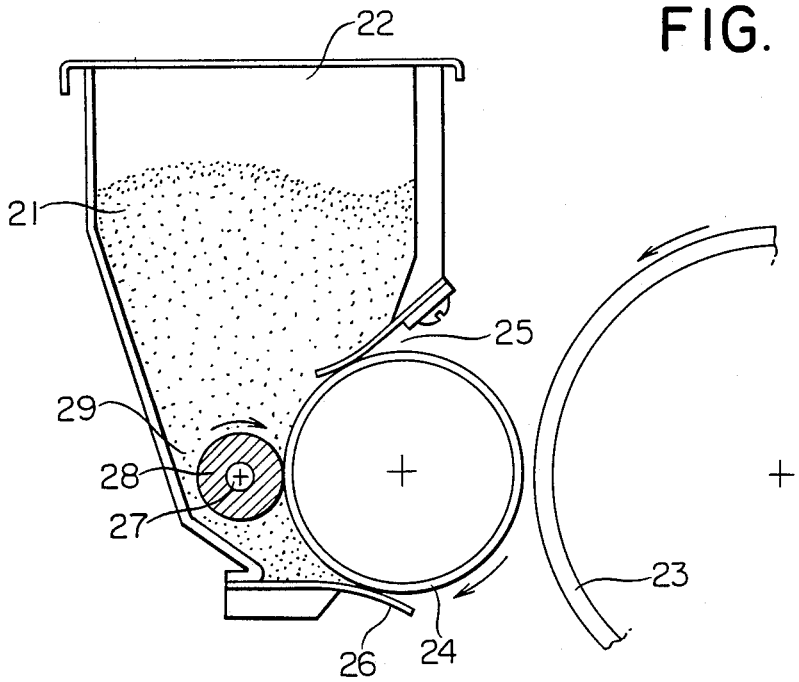
FIG. 7 is a cross section illustrating the essential part of another typical developing apparatus embodying the present invention.

FIG. 7 is a cross section of the essential part of another typical developing apparatus as an improved version of the embodiment of the invention shown in FIG. 3.

Figure 8:
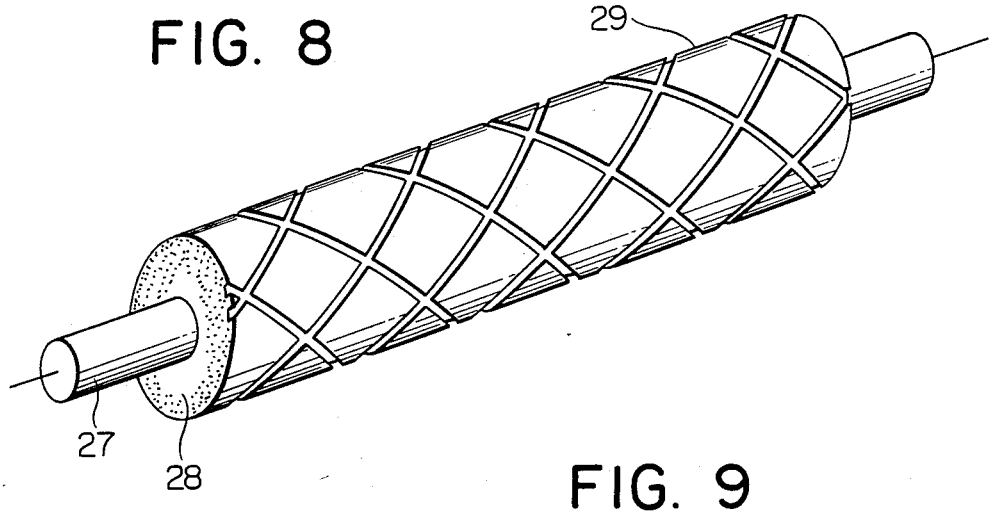
FIG. 8 is a schematic perspective view illustrating a typical toner stirrer.
Figure 9:
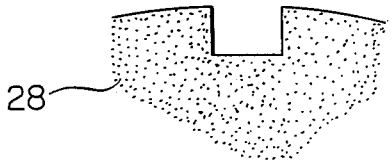
FIG. 9 is a cross section showing the shape of the toner stirrer of FIG. 8.

In this embodiment, as the toner stirrer, an elastic roller 29 having a layer of polyurethane foam superposed concentrically on the peripheral surface of a shaft 27 is used. Inside a developing agent container 22, this elastic roller 29 is revolved clockwise as kept in contact with the peripheral surface of a developing roller 24. On the peripheral surface of the polyurethane foam layer 28, helical grooves are inserted as shown in FIG. 8. In the present embodiment, the grooves have a width of 2 mm and a depth of 2 mm and a cross section of the shape shown in FIG. 9. Though these grooves may be formed as inclined in one direction, they are desired to be formed as inclined in two directions as illustrated for the purpose of producing effective stirring of the toner and preventing possible deflection of the toner distribution within the developing agent container 22. A metal plate blade 25 and a sensitive drum 23 used in the present embodiment are identical with the corresponding components used in the embodiment of FIG. 3.

In the developing apparatus constructed as described above, of the toner in the thin layer formed in consequence of the rotation of the developing roller 24, the part of the toner which has not participated in the development of an image, has passed under the pressure of the elastic sheet member 26 for toner recovery, and has been returned to the interior of the developing agent container 22 comes into contact with the rotating elastic roller 29. At this point, part of the toner on the surface of the developing roller 24 is scraped off by a porous polyurethane foam 28 inside the developing agent container 22 and then forwarded in the direction of length of the roller along the helically intersecting grooves.

By the stirring effect produced as described above by the elastic roller 29, the electrostatic cohesion of toner particles is repressed and the formation of streaks in the peripheral direction of the roller is prevented. When the peripheral surface of the elastic roller 29 is wrapped with a porous material such as polyurethane foam as illustrated in the present embodiment, since the toner is retained in the grooves of irregularities on the surface, the toner is readily supplied to the roller surface and the uniform toner layer is formed at all times even when the toner is supplied smoothly to the surface of the developing roller 24 and, as a result, the toner is amply consumed in the development of images of numerous line pairs. Further when spherical grooves are formed in two intersecting directions on the surface of the elastic roller as illustrated, the possibility of the toner being unevenly distributed inside the developing agent container is nil.

Now, an experiment in which image duplications by the conventional method were carried out by the use of the developing apparatus of this invention will be described below.

Experiment (Conditions)

Developing roller

A developing roller was produced by subjecting the peripheral surface of an aluminum cylinder 24 mm in outside diameter to a polishing treatment, a sand blasting treatment (for surface roughness of 2 μm, Rz), and an electroless nickel plating treatment. To the developing roller, a DC bias voltage of +100 V was applied for the purpose of preventing the occurrence of image fogging.

Elastic sheet member for formation of toner layer

An elastic sheet member for the formation of a toner layer was made of a phosphor bronze sheet 0.2 mm in thickness. The pressure, P, applied to the roller was 100 g/cm. The pressure, P, mentioned above is the value calculated by the formula, $P=Po/l$ where "l" stands for the length of the blade and "Po" for the total pressure applied on the roller.

Non-magnetic toner

A toner consisting preponderantly of a polyester type substance and further incorporating therein a pigment such as carbon and other additives and having an average particle diameter of 12 μm was used.

Sensitive drum

A sensitive drum produced by forming a layer of selenium type photoconductive material on the peripheral surface of an aluminum cylinder and having an outer diameter of 80 mm was used. The peripheral speed of this sensitive drum was equal to that of the aforementioned developing roller. This sensitive drum was rotated counterclockwise, namely, in a direction opposite the direction of the rotation of the aforementioned roller. The maximum potential of the elctrostatic image formed on the surface of the sensitive drum was +800 V. The sensitive drum was disposed so that the distance of the surface of the sensitive drum to the surface of the roller would be 0.2 mm when the two members approached most to each other.

Elastic roller

An elastic roller consisted of a stainless steel shaft 8 mm in outside diameter and polyurethane foam coating 15 mm in outside diameter. The elastic roller was disposed so that a nipping width of 3 mm would occur between the elastic roller and the developing roller.

The development was carried out by a method, which comprised rotating the developing roller 24 at a peripheral speed of 130 mm/sec and the elastic roller at a peripheral speed of 30 mm/sec respectively both in the clockwise direction, forming a thin layer of toner about 25 μm in thickness on the surface of the developing roller 24, and a allowing the toner which has been negatively charged by the frictional electrification with the elastic sheet member 25 for the formation of a toner layer to be transferred toward the sensitive drum 3 by the Coulomb force. Even after 10,000 cycles of the duplication mentioned above, the developed images showed no discernible lack of uniform density and the toner layer on the surface of the developing roller showed no sign of unevenness.

The embodiment has been described as using an elastic roller as the toner stirrer. This invention does not require the toner stirrer to be limited to the elastic roller. For example, a mesh plate possessing elasticity and wrapped around a developing roll an elastic sheet formed of an elastic flat sheet possessing minute irregularities on the surface thereof may be used instead.

We claim:

1. A developing apparatus for developing a latent image formed on an image carrier by a cone-component developing agent composed of a non-magnetic toner, said developing apparatus comprising: a nonmagnetized movable developing agent carrier for carrying and for supplying said one-component developing agent to an image transfer member; and an elastic coating member having a thickness in the range of about 0.1 to 0.4 mm formed of an elastic plate disposed to press on the surface of said movable developing agent carrier and supported in place at one end thereof, wherein said elastic coating member is disposed so that the free end thereof is directed opposite the direction of the movement of said movable developing agent carrier, and said elastic coating member is disposed so that the lateral surface of said elastic coating member except for a terminal part thereof will contact said movable developing agent carrier.

2. A developing apparatus according to claim 1, wherein the distance from the position of contact between said elastic coating member and said movable developing agent carrier to the free end of said elastic coating member is in the range of 1 mm to 5 mm.

3. A developing apparatus according to claim 1, wherein the surface of said movable developing agent carrier is a rough surface having average roughness in the range of about 0.3 μm Rz to 5.0 μm Rz.

4. A developing apparatus according to claim 1, wherein said elastic coating member is disposed against said movable developing agent carrier with a force of pressure in the range of about 10 g/cm to 100 g/cm.

5. A developing apparatus according to claim 1, wherein said elastic coating member is adapted to apply said one-component developing agent composed of a non-magnetic tone in a thickness of not less than 10 μm and not more than 80 μm on the surface of said movable developing agent carrier.

6. A developing apparatus according to claim 1 wherein an absolute value of electric charge imparted to said one-component developing agent composed of a non-magnetic toner is not less than 2 μC/g and not more than 20 μC/g.

7. A developing apparatus for developing a latent image formed on an image carrier by a one-component developing agent composed of a non-magnetic tone, said developing apparatus comprising: a non-magnetized movable developing agent carrier for carrying and for supplying said one-component developing agent to an image transfer member; and an elastic coating member having a thickness in the range of 0.1 to 0.4 mm formed of an elastic plate disposed to press on the surface of said movable developing agent carrier and supported in place at one end thereof, wherein said elastic coating member is disposed so that the free end thereof is directed opposite the direction of movement of said movable developing agent carrier, and the surface of said movable developing agent carrier has undergone the treatment of polishing to a first finish, roughening to a second finish, and electroless nickel plating in the order mentioned.

8. A developing apparatus according to claim 7, wherein said electroless nickel plating has a thickness in the range of 5 to 20 μm.

9. A developing apparatus according to claim 9, wherein said movable developing agent carrier which has undergone the treatments of polishing, roughening electroless nickel plating has a surface roughness in the range of 0.3 to 5.0 μm (Rz).

10. A developing apparatus for developing a latent image formed on an image carrier using a one-component non-magnetic toner, said developing apparatus comprising: a non-magnetized movable developing agent carrier for carrying and for supplying said one-component developing agent to an electrostatic latent image and an elastic coating member formed of an elastic plate having a thickness in the range of about 0.1 to 0.4 mm disposed to press on the surface of said movable developing agent carrier and supported in place at one end thereof, wherein said elastic coating member is disposed so that the free end thereof is directed opposite the direction of movement of said movable developing agent carrier and said developing agent container is provided therein with a toner stirring member disposed contiguously to or in sliding contact with said movable developing agent carrier and for making the toner uniform on the surface of said movable developing agent carrier.

11. A developing apparatus according to claim 10, wherein said toner stirring member comprises an elastic roller adapted to be kept in contact with the surface of said developing roller as said elastic roller revolves.

12. A developing apparatus according to claim 10, wherein said toner stirring member comprises an elastic roller made of polyurethane foam.

13. A developing apparatus according to claim 10, wherein said toner stirring member comprises an elastic roller made of polyurethane foam and said elastic roller is provided on the surface thereof with helical grooves.

* * * * *

UNITED STATES PATENT AND TRADEMARK OFFICE

CERTIFICATE OF CORRECTION

PATENT NO. : 4,866,480

DATED : September 12, 1989

INVENTOR(S) : Masahiro HOSOYA et al.

It is certified that error appears in the above-identified patent and that said Letters Patent is hereby corrected as shown below:

Please note that Column 11, line 54, contains a typographical error wherein "a cone-component" should read -- a one-component --.

Signed and Sealed this

Twenty-first Day of December, 1999

*Attest:*

Q. TODD DICKINSON

*Attesting Officer*

*Acting Commissioner of Patents and Trademarks*